US008781369B2

(12) United States Patent
Furukawa et al.

(10) Patent No.: US 8,781,369 B2
(45) Date of Patent: Jul. 15, 2014

(54) CHARGING ROLLER AND PROCESS FOR ITS PRODUCTION

(71) Applicant: Canon Kabushiki Kaisha, Tokyo (JP)

(72) Inventors: Takumi Furukawa, Susono (JP); Masaaki Harada, Yokohama (JP); Hiroaki Watanabe, Odawara (JP); Keiji Nose, Machida (JP); Kenya Terada, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/945,028

(22) Filed: Jul. 18, 2013

(65) Prior Publication Data

US 2013/0302064 A1 Nov. 14, 2013

Related U.S. Application Data

(63) Continuation of application No. PCT/JP2012/005814, filed on Sep. 13, 2012.

(30) Foreign Application Priority Data

Jan. 18, 2012 (JP) ..... 2012-008344

(51) Int. Cl.
*G03G 15/02* (2006.01)

(52) U.S. Cl.
USPC ..... 399/176; 29/895.32; 492/30

(58) Field of Classification Search
CPC ..... G03G 15/0233; G03G 15/02; G03G 15/0216; G03G 15/0818; G03G 15/00; G03G 15/1685; G03G 15/025; G03G 15/0225; G03G 21/1814; G03G 2215/00957; G03G 15/2057; G03G 15/75; G03G 21/18; G03G 2215/025; G03G 2221/1654; G03G 5/04; G03G 13/025; G03G 15/0208; G03G 15/0258; G03G 15/0266; G03G 15/065; G03G 15/0803; G03G 15/0808; G03G 15/0928; G03G 15/162; G03G 15/751; G03G 21/005; G03G 21/0094; G03G 21/1619; G03G 21/1647; G03G 21/169; G03G 21/185; G03G 2215/0132; G03G 2215/02; G03G 2215/021; G03G 2215/0607; G03G 2215/1614; G03G 2221/1618; G03G 2221/1678; G03G 5/00
USPC ..... 399/176; 492/30; 29/895.32
See application file for complete search history.

(56) References Cited

U.S. PATENT DOCUMENTS

| | | | |
|---|---|---|---|
| 7,869,741 | B2 | 1/2011 | Mayuzumi et al. |
| 2011/0044725 | A1 | 2/2011 | Mayuzumi et al. |
| 2012/0045250 | A1 | 2/2012 | Harada et al. |

FOREIGN PATENT DOCUMENTS

| | | | |
|---|---|---|---|
| JP | 2001-92221 | A | 4/2001 |
| JP | 2001-278746 | A | 10/2001 |

(Continued)

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

A roller for electrophotography has an electrically conductive support and an elastic layer as a surface layer. The elastic layer holds spherical particles each having a plane on their peripheral surfaces, in such a way that part or the whole of the plane comes exposed to the surface of the elastic layer, and the plane of each of the spherical particles standing exposed to the surface of the elastic layer and a plane that is i) orthogonal to a straight line passing through an axis of a section orthogonal to an axis of the roller for electrophotography and being directed toward the peripheral surface of the roller for electrophotography and is ii) tangential to the peripheral surface of the roller for electrophotography form an acute internal angle.

14 Claims, 4 Drawing Sheets

(56) References Cited

FOREIGN PATENT DOCUMENTS

| | | | | |
|---|---|---|---|---|
| JP | 2007-225914 | A | | 9/2007 |
| JP | 2007-232876 | A | | 9/2007 |
| JP | 2008-276026 | A | | 11/2008 |
| JP | 2010-134451 | A | | 6/2010 |
| JP | 2011-158756 | A | | 8/2011 |
| JP | 2013167866 | A | * | 8/2013 |
| WO | 2012/008122 | A1 | | 1/2012 |

* cited by examiner

CHARGING ROLLER AND PROCESS FOR ITS PRODUCTION

CROSS-REFERENCE TO RELATED APPLICATIONS

This application is a continuation of International Application No. PCT/JP2012/005814, filed Sep. 13, 2012 which claims the benefit of Japanese Patent Application No. 2012-008344, filed Jan. 18, 2012.

BACKGROUND OF THE INVENTION

1. Field of the Invention

This invention relates to a roller for electrophotography which is used as a charging roller or the like in electrophotographic apparatus, and a process for its production.

2. Description of the Related Art

A charging roller of a contact charging assembly is so disposed as to be kept in contact with an electrophotographic photosensitive member (hereinafter called "photosensitive member"; at a stated pressing force by a pressing means such as springs provided on both sides of the former's shaft, and be followingly rotated as the photosensitive member is rotated. As such a charging roller, in order to improve the uniformity of images, a charging roller on the surface of which an unevenness of about few μm has been formed is known in the art.

Japanese Patent Application Laid-open No. 2007-225914 discloses a charging roller having art electrically conductive support, a resistance control layer and a surface coat, where roughened-surface forming particles are exposed to the surface of the surface coat so as to form the unevenness. In such a charging roller, the state of exposure of the particles to the surface is controlled to achieve a superior charging performance. Also, in such a charging roller, its contact with the photosensitive member stands multiple-point contact basically, and hence the coefficient of dynamic friction lowers to bring an effect that toners, external additives, paper dust and so forth can be kept from sticking to its surface.

SUMMARY OF THE INVENTION

However, as electrophotographic apparatus have been made high-speed and small-sized in recent years, there has been a case in which a new problem comes about when such a charging roller which is so constituted that the roughened-surface forming particles stand exposed to the surface of the surface coat is used in a high-speed drive and with a diameter made small. That is, a slippage may occur between the photosensitive member and the charging roller at the initial stage of their rotation, and a difference in charge potential may come between the part where the charging roller has slipped and the part where it has not slipped, so that electrophotographic images may come to have horizontally streaky non-uniformity.

Accordingly, the present invention is directed to providing a roller for electrophotography to the surface of which toners and so forth can be kept from sticking and which can not easily cause a slippage on the photosensitive member, and provide a process for its production.

Further, the present invention is directed to providing an electrophotographic apparatus and a process cartridge which contribute to stable formation of high-grade electrophotographic images.

According to one aspect of the present invention, there is provided a roller for electrophotography, comprising an electrically conductive support and an elastic layer as a surface layer, wherein, the elastic layer holds spherical particles each having a plane on their peripheral surfaces, in such a way that part or the whole of the plane comes exposed to the surface of the elastic layer; and wherein, the plane or each of the spherical particles standing exposed to the surface of the elastic layer, and a plane that is orthogonal to a straight line passing through an axis center in a section orthogonal to an axis of the roller for electrophotography and being directed toward the peripheral surface of the roller for electrophotography, and that is tangential to the peripheral surface of the roller for electrophotography, make an acute internal angle.

According to another aspect of the present invention, there is provided a roller for electrophotography, comprising an electrically conductive support and an elastic layer as a surfaces layer, wherein, the elastic layer contains a resin binder and spherical particles for roughening the surface of the roller for electrophotography, the spherical particles each having a plane on their peripheral surfaces, and part or the whole of the plane of each of the spherical particles standing exposed to the surface of the surface layer in such a way as to be directed toward the outside of the elastic layer.

According to a further aspect of the present invention, there is provided a process for producing the aforementioned roller for electrophotography; the process comprising the steps of forming on an electrically conductive support an elastic layer containing a resin binder in which spherical particles have been dispersed, and thereafter, grinding the surface of the elastic layer to make part of each of the spherical particles exposed to the surface and at the same time form a plane on each peripheral surface of the spherical particles.

According to further aspect of the present invention, there is provided an electrophotographic apparatus comprising a charging roller and a rotating drum-type type photosensitive member disposed in contact with the charging roller, the charging roller being the afore mentioned roller for electrophotography.

According to still further aspect of the present invention, there is provided a process cartridge comprising a charging roller and a rotating drum-type photosensitive member disposed in contact with the charging roller, and being so constituted as to be detachably mountable to the main body of an electrophotographic apparatus, the charging roller being the afore mentioned roller for electrophotography.

According to the present invention, a roller for electrophotography can be obtained to the surface of which toners and so forth can not easily stick and which, at the start of its rotation, can not easily cause a slippage on a member coming in contact therewith. According to the present invention, an electrophotographic apparatus and a process cartridge can also be obtained which contribute to stable formation of high-grade electrophotographic images.

Further features of the present invention will become apparent from the following description of exemplary embodiments wish reference to the attached drawings.

DESCRIPTION OF THE EMBODIMENTS

Preferred embodiments of the present invention will now be described in detail in accordance with the accompanying drawings.

The roller for electrophotography according to the present invention is constituted to have at least an electrically conductive support and an elastic layer as a surface layer. The roller for electrophotography contains a resin binder and spherical particles for roughening its surface.

Then, the surface layer holds the spherical particles. The spherical particles each have at least one plane on their peripheral surfaces. Then, the spherical particles are held by the surface layer in such a way that part or the whole of the plane comes exposed to the surface of the elastic layer.

The spherical particles are also held in the surface layer in such a way that part or the whole of the plane each of the spherical particles, standing exposed to the surface of the surface layer, is directed toward the outside.

More specifically, the spherical particles are held in the elastic layer in such a way that the "plane" of each of the spherical particles standing exposed to the surface of the roller for electrophotography and an "plane i) that is orthogonal to a straight line passing through an axis of a section orthogonal to an axis of the roller for electrophotography and being directed toward the peripheral surface of the roller for electrophotography and ii) that is tangential to the peripheral surface of the roller for electrophotography" make an acute internal angle.

Figure 2:
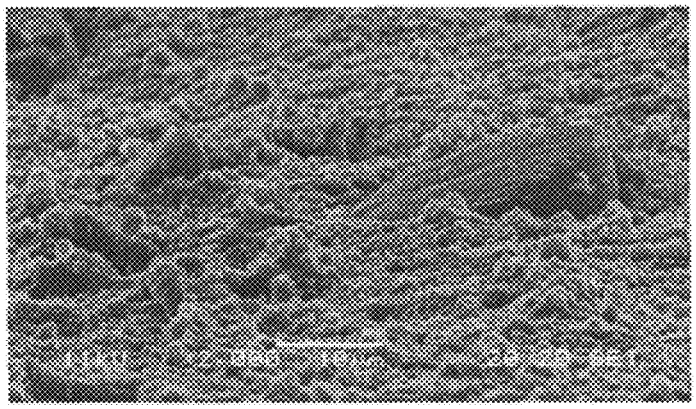
FIG. 2 is an electron micrograph of the surface of the charging roller according to the present invention.

FIG. 2 shows an observation of the surface of the charging roller according to the present invention, with an electron microscope. Thus, the plane each of the spherical particles has stands exposed to the surface of the roller for electrophotography in such a state that it so inclines as to be at an acute internal angle to the surface of the roller for electrophotography. Here, the plane each of the spherical particles has refers to, e.g., a portion having a breadth of 10 $\mu m^2$ or more and an altitude difference of 0.5 μm or less in the direction perpendicular to its in-plane flat surface.

In addition to hills formed in virtue of the spherical particles standing exposed to the surface (hereinafter also "hills formed by the spherical particles"), as shown in FIG. 2, hills having not more than substantially the same height as hills formed by such spherical particles may also be present on the surface of the roller for electrophotography according to the present invention.

Where the area of the peripheral surface of the roller for electrophotography according to the present invention is regarded as 100%, the area held by the surfaces of the spherical particles standing exposed to the surface may preferably be in a proportion of from 1% or more to 30% or less.

Figure 1:
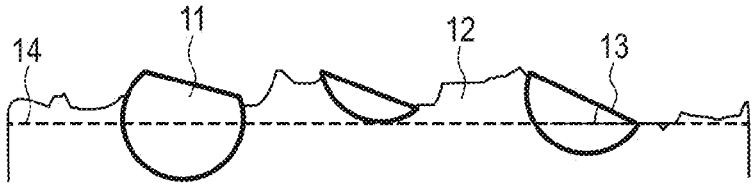
FIG. 1 is a diagrammatic view showing a section of the vicinity of the surface of the charging roller according to the present invention.

Further, in order to detail how the spherical particles are exposed to the surface, a diagrammatic view of the vicinity of the surface of the roller for electrophotography according to the present invention in a section in the direction orthogonal to its axis is given in FIG. 1.

As shown in FIG. 1, a resin binder 12 and spherical particles 11 for roughening the roller surface stand exposed to the surface of the roller for electrophotography, and the spherical particles each have at least one plane. The plane each of the spherical particles has stands exposed to the surface in such a state that it inclines toward a plane 14 tangential to the roller circumference (microscopically, the plane that passes through what corresponds to an average external diameter of the roller for electrophotography). The angle made by the plane of each of the spherical particles and the plane 14 coming in contact with the peripheral surface of the roller for electrophotography, forms an acute internal angle 13. That is to say, the plane that is tangential to the roller peripheral surface orthogonal to a straight line passing through the axis center of the roller for electrophotography and being directed toward the peripheral surface of the roller for electrophotography, and the plane each of the spherical particles has, forms an acute internal angle. In what is described hereinafter, the acute internal angle the plane of each of the spherical particles terms with respect to the plane that is tangential to the roller peripheral surface orthogonal to a straight line passing through the axis of the roller for electrophotography and being directed toward the peripheral surface of the roller for electrophotography is simply also termed "angle of inclined plane".

Measurement of Inclined-Plane Angle:

The angle of inclined plane may be calculated from a three-dimensional observation image of the surface of the roller for electrophotography. As a microscope for such observation, a laser microscope VK8700 (manufactured by Keyence Co.) may be used.

An image of the surface of the roller for electrophotography, observed in a visual field of approximately 300 μm×300 μm is analyzed by using software attached to the laser microscope to obtain a roughness profile. Here, an average line of linear roughness of the surface of the roller for electrophotography corresponds to a line segment on the plane that is tangential to the roller peripheral surface orthogonal to a straight line passing through the axis of the roller for electrophotography and being directed toward the peripheral surface of the roller for electrophotography. Accordingly, the angle that is formed by a line segment on the inclined plane of each of the spherical particles and the average line of linear roughness of the surface of the roller for electrophotography is calculated. By this method, the angles of inclined planes are measured about 100 spots on the surface of the roller for electrophotography where planes of the spherical particles standing exposed to the surface, which are planes of the spherical particles standing exposed to the surface of the elastic layer, and an arithmetic, mean vale of these is taken as the angle of inclined plane of one roller for electrophotography.

Then, in the present invention, the value of the angle of inclined plane may preferably be approximately from 4 degrees to 30 degrees, and particularly from 5 degrees to 20 degrees.

Figure 3:
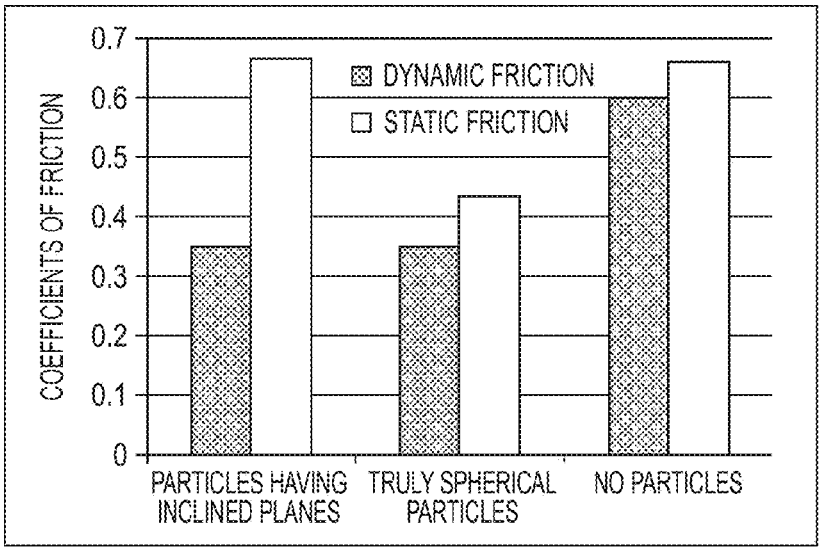
FIG. 3 is a bar graph of the coefficient of dynamic friction and coefficient of static friction of charging rollers.

In FIG. 3, a coefficient of static friction and a coefficient of dynamic friction are shown about each of a roller for electrophotography to the surface of which the inclined planes stand exposed, a roller for electrophotography to the surface of which truly spherical particles stand exposed, which have no planes, and a roller for electrophotography to the surface of which no particles stand exposed and which has a flat surface.

These are all common rollers except for whether or not the inclined planes standing exposed to the surface are present on the surface. The coefficient of static friction and the coefficient of dynamic friction are measured by a method described below.

Figure 4:
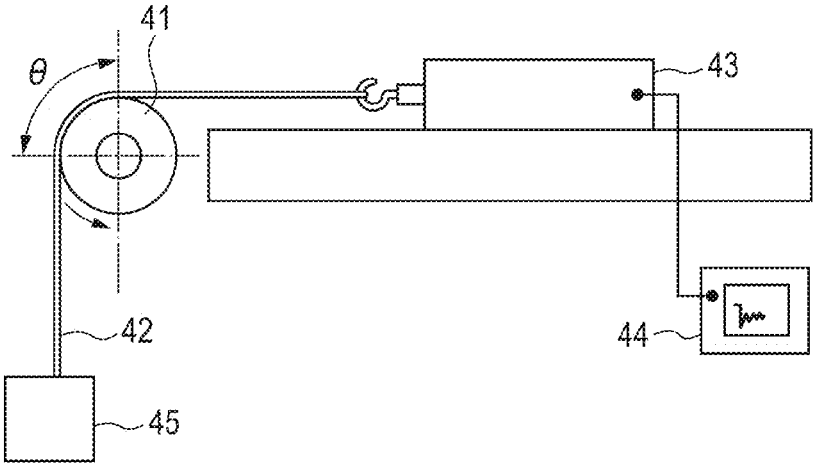
FIG. 4 is a diagrammatic view of an instrument with which coefficients of friction are measured.

Measurement of Coefficient of Friction:

An example (outline) of how to measure the coefficient of friction is shown in FIG. 4. This measuring method is a method preferable when a member to be measured has the shape of a roller, and is a method based on Euler's belt formula. A charging roller 41 that is the member to be measured and a belt 42 stand in contact with each other at a stated angle (θ). The belt is joined with a measuring section (a load meter 43 and a recorder 44) at one end thereof and with a weight 45 at the other end. When in this state the charging roller is rotated in a stated direction and at a stated speed, the force measured at the measuring section is represented by F (g) and the mass of the weight is represented by W (g), the coefficient of friction (μ) is found according to the following expression:

$$\mu=(1/\theta)\ln(F/W).$$

Figure 5:
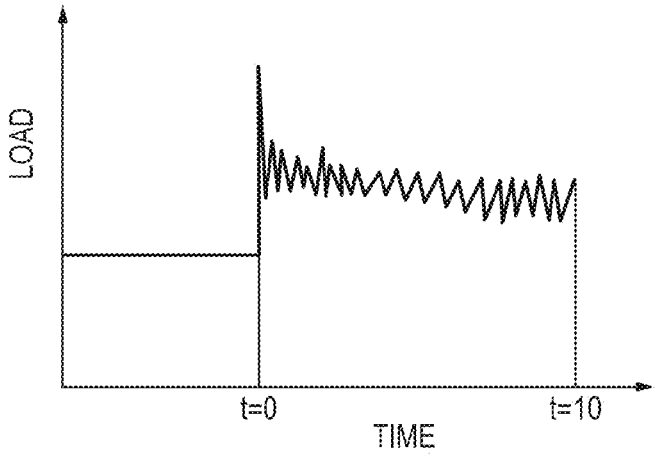
FIG. 5 shows an example of measured data of a coefficient of friction.

An example of a chart obtained by this measuring method is shown in FIG. 5. The value that is found immediately after the roller for electrophotography has been rotated is the force that is necessary for it to start to be rotated, and the value that follows the same is the force that is necessary for the roller to continue to be rotated. The force at a point of start of the rot sit ion (i.e., a point in time of t=0) is taken as static frictional force, and also an average value at a time for a period of 8≤t(second)≤10 is taken as dynamic frictional force.

As a material for the belt, a polyester film (thickness: 100 μm; width: 30 mm; length: 180 mm; trade name: LUMILAR S10, #100; available from Toray Industries, Inc.) is used, and the measurement is made at a load of 100 g, at a number of revolutions of 115 rpm and at intervals for data store, of 100 times/second. From the dynamic frictional force and static frictional force obtained under such conditions, a coefficient of dynamic friction μD and a coefficient of static friction μS are calculated.

As shown in FIG. 3, in the roller to the surface of which truly spherical particles stand exposed, both the coefficient of static friction μS and the coefficient of dynamic friction μD are small and, in the roller to the surface of which no spherical particles stand exposed, both the coefficient of static friction μS and the coefficient of dynamic friction μD are large. On the other hand, in the roller to the surface of which the inclined planes coming from the present spherical particles stand exposed, the coefficient of dynamic friction μD comes small like the roller for electrophotography to the surface of which truly spherical particles stand exposed and the coefficient of static friction μD comes large like the roller for electrophotography to the surface of which no spherical particles stand exposed.

From these results, it is presumed that the roller for electrophotography of the present invention can keep any contaminants from sticking thereto to stain and also can keep itself from slipping at the initial stage of rotation, by the mechanism as stated below.

Figure 6:
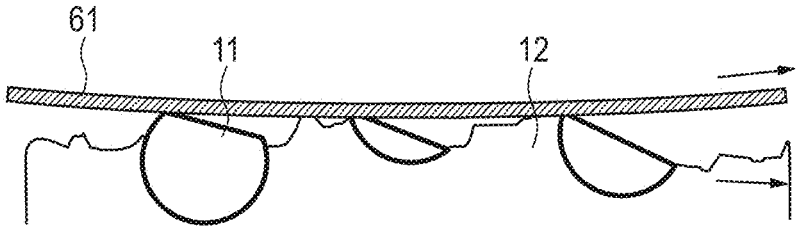
FIG. 6 is a diagrammatic view showing the state of contact between the charging roller according to the present invention and a photosensitive member when they are rotated.

In the first place, from the result of experiment that the coefficient of dynamic friction is small, it is presumed that, when the roller for electrophotography is rotated, as shown in FIG. 6 it is in multiple-point contact with a photosensitive member 61 at edges of the spherical particles having inclined planes. Inasmuch as the coefficient of dynamic friction is small, even upon inclusion of any contaminants, such contaminants are kept from being rubbed against the roller for electrophotography when it is rotated.

Figure 7:
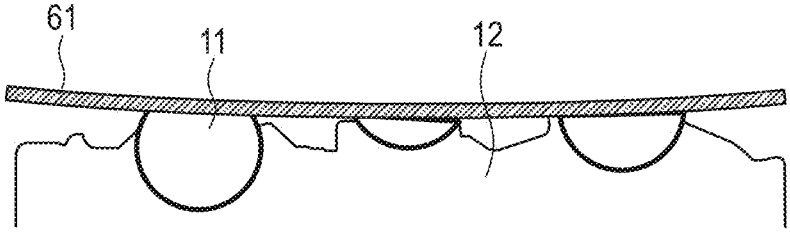
FIG. 7 is a diagrammatic view showing the state of contact between the charging roller according to the present invention and a photosensitive member when they stand still.
Figure 8:
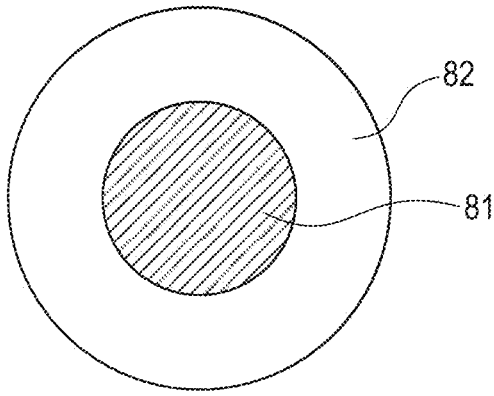
FIG. 8 is a diagrammatic view showing an example of the charging roller according to the present invention.

Further, from the result of experiment that the coefficient of dynamic friction is large, it is presumed that, when the roller for electrophotography stands still, as shown in FIG. 7 it is in multiple-plane contact with the photosensitive member at planes of the spherical particles having inclined planes. Inasmuch as the coefficient of dynamic friction is large, the roller for electrophotography is kept from slipping, because it is followingly rotated as the photosensitive member is rotated.

Changes in the state of contact at the time of rotation and at the rime of standing still are expected to come upon deformation of the resin binder, which is relatively soft with respect to the spherical particles having inclined planes. Further, it is considered that the property of resin binder such that it deforms with difficulty against any high-frequency stimulation like that at the time of rotation and deforms with ease against any low-frequency stimulation like that at the time of standing still brings the changes in the state of contact at the time of rotation and at the time of standing still.

For the reason as above, any faulty images can be kept from occurring which are due to the sticking of toners and so forth and also any charging non-uniformity can be kept from occurring which is caused by the slippage at the initial stage of rotation when the roller is followingly rotated in contact with the rotating drum-type photosensitive member, as so considered. Also, in the roller for electrophotography according to the present invention, the ratio of the coefficient of static friction μS to the coefficient of dynamic friction μD, i.e., μS/μD, may preferably be larger than 1.4.

The roller for electrophotography according to the present invention is constituted as described below in detail. As a form of the roller for electrophotography, it may include a charging roller provided with, as shown in FIG. 6, an electrically conductive support 81 and an elastic layer 82 as the surface layer.

—Elastic Layer—

The elastic layer as the surface layer contains at least the resin binder and also holds the spherical particles each having a plane on their peripheral surfaces, in such a way that part or the whole of the plane comes exposed to the surface of the elastic layer. This makes the surface of file elastic layer, i.e., the surface of the roller for electrophotography, roughened.

Resin Binder:

The resin binder is not particularly limited as long as it can provide the elastic layer with rubber elasticity in the range of actual-service temperature of the roller for electrophotography.

Specific examples of the resin binder are given below: Thermosetting rubber materials obtained by compounding a raw-material rubber with a cross-linking agent, which raw-material rubber including natural rubber (NR), isoprene rubber (IR), butadiene rubber (BR), styrene-butadiene rubber (SBR), butyl rubber (IIR), an ethylene-propylene-diene terpolymer rubber (EPDM), an epichlorohydrin homopolymer (CO), an epichlorohydrin-ethylene oxide copolymer (ECO), an epichlorohydrin-ethylene oxide-acrylic glycidyl ether terpolymer (GECO), an acrylonitrile-butadiene copolymer (NBR), a hydrogenated product of acrylonitrile-butadiene copolymer (H-NBR), chloroprene rubber (CR) and acrylic rubbers (ACM, ANM); and thermoplastic elastomers such as polyolefin type thermoplastic elastomers, polystyrene type thermoplastic elastomers, polyester type thermoplastic elastomers, polyurethane type thermoplastic elastomers, polyamide type thermoplastic elastomers, and vinyl chloride type thermoplastic elastomers; any of which may be used. Any of these may be used alone or in combination of two or more types.

To the elastic layer, a conductive agent may be added as an additive, for the purpose of controlling electrical resistance of the elastic layer. A filler, a processing aid, an antioxidant, a cross-linking agent, a cross-linking accelerator, a cross-linking accelerator activator, a cross-linking retarder, a dispersant, a plasticizer, a softening agent and so forth may also optionally be added thereto which are commonly used as compounding agents for rubbers.

Spherical Particles:

The spherical particles may preferably have an average particle diameter of from 3 μm to 50 μm. As long as their average particle diameter is 3 μm or more, the area of contact with the photosensitive member ran be kept from increasing because of the particle diameter that may otherwise be small. Also, as long as their average particle diameter is 50 μm or less, any defects of charging can be kept from being seen on images because of the particles that may otherwise be too large. The spherical particles may have an average particle diameter of from 4 μm to 20 μm as a further preferable range.

As the average particle diameter of the spherical particles, volume average particle diameter obtained by the following method shall be employed.

The surface layer is cut out at its arbitrary spots at intervals of 20 nm over the length of 500 μm by using a focused ion beam processing instrument (FB-2000C; manufactured by Hitachi Ltd.), and their sectional images are photographed on an electron microscope. Then, images of the like spherical particles photographed are combined therewith at intervals of 20 nm to calculate stereoscopic particle shapes. This is operated on arbitrary 100 particles of the spherical particles, and these are taken as object particles for measurement. Sphere-equivalent diameters of particles having a volume calculated from the individual stereoscopic particle shapes obtained is taken as a volume average particle diameter, and an average value of volume average particle diameters of all object particles is taken as the volume average particle diameter.

A material for the spherical particles may include, e.g., acrylic resins, polybutadiene resins, polystyrene resins, phenol resins, polyamide resins, nylon resins, fluorine type resins, silicone resins, epoxy resins and polyester resins. In order to enhance the effect of the present invention, it is preferable to use spherical particles that are relatively hard compared with the resin binder.

As methods for kneading the resin binder, the additives therefor and the spherical particles, usable are a method making use of a closed kneading machine such as Banbury mixer, an intermix kneader or a pressure kneader and a method making use of an open kneading machine such as an open roll.

As a method, by which a kneaded product obtained by the kneading is formed in layer on the electrically conductive support, a forming method such as extrusion, injection molding or compression molding may be used. Cross-head extrusion by which the kneaded product that is to become the elastic layer is extruded integrally with the electrically conductive support is preferable taking account of, e.g., mating the working therefor efficient. Thereafter, where it is necessary to cross-link the resin binder, it is preferable to go through the step of cross-linking such as mold cross-linking, vulcanizer cross-linking, continuous cross-linking, far- or near infrared cross-linking, or induction heat cross-linking.

Where the spherical particles do not stand exposed to the surface of the elastic layer having been thus formed, grinding may be carried out. Carrying out the grinding can make the surface smooth or precisely finish its profile. As a grinding method, a traverse grinding system or a plunge-cut grinding system may be employed. The traverse grinding system is a method in which a short grinding wheal is moved to the roller surface to grind the surface. In contrast thereto, the plunge-cut grinding system is a method in which a grinding wheel larger in width than the length of the elastic layer is used and the grinding wheel is forwarded in the radius direction of the grinding wheel to carry out grinding. The plunge-cut grinding system is preferable because the time for working can be made shorter.

Surface treatment may further be carried out by irradiation with ultraviolet rays or electron rays in order to, e.g., make the elastic layer surface non-adherent and prevent the elastic layer from causing any bleeding or blooming from its interior.

—How to Produce Roller for Electrophotography to the Surface of which the Inclined Planes Coming from Spherical Particles Stand Exposed—

As methods for producing the roller for electrophotography according to the present invention to the surface of which the inclined planes coming from the spherical particles stand exposed, the following (A) to (C) methods are exemplified.

(A) A method in which the spherical particles having inclined planes, e.g., hemispherical-shaped spherical particles, are beforehand mixed with the resin binder, followed by forming.

(B) A method in which the spherical particles having inclined planes, e.g., hemispherical-shaped spherical particles, are attached to the surface of the elastic layer in such a way that the planes of hemispheres face outward.

(C) A method in which spherical particles standing exposed to the surface are post-worked to form the inclined planes.

The method of the above method (A), in which the hemispherical-shaped spherical particles are beforehand mixed with the resin binder, followed by forming, may make it difficult depending on the forming method to control the state of exposure of the hemispherical-shaped spherical particles or the angles of inclination of the inclined planes of hemispheres.

The method of the above method (B), in which the hemispherical-shaped spherical particles are attached to the surface of the elastic layer in such a way that the planes of hemispheres face outward, may make a step complicated which is to attach to the surface the hemispherical-shaped spherical particles.

The method of the above method (C), in which the spherical particles standing exposed to the surface are post-worked to form the inclined planes, can provide uniform internal angles the inclined planes and the imaginary plane tangential to the peripheral surface of the roller for electrophotography form, and can be said to be a preferable method.

Incidentally, the hemispherical-shaped spherical particles may also be produced by a method disclosed in Japanese Patent Application Laid-open No. 2001-278746.

Instead, the most preferable method [hereinafter "method (D)"] is a method in which a layer containing the resin binder and the spherical particles, having been dispersed in the resin binder, is formed on the peripheral surface of the electrically conductive support, and the surface of this layer is put to plunge-cut grinding by using a roller-shaped grinding wheel. Stated in greater detail, it is preferable for the method (D) to include the following steps (D-i) to (D-iii).

(D-i) The step of forming on a roller-shaped conductive support a layer containing NBR or CO, ECO, GECO or the like epichlorohydrin rubber as the resin binder in which spherical particles composed of acrylic resin or styrene resin leave been dispersed;

(D-ii) the step of disposing the roller-shaped grinding wheel in such a way that its rotating shaft comes in parallel to the rotating shaft of the roller-shaped conductive support; and (D-iii) the surface of the layer containing the spherical particles and the resin binder, formed on the electrically conductive support, is ground by means of the grinding wheel to make at least part of each of the spherical particles exposed to the surface of the layer and at the same time form the planes on the peripheral surfaces of the spherical particles.

According to this production method, the roller for electrophotography to the surface of which at least part of each of the inclined planes of the spherical particles standing exposed to the surface can be obtained with ease.

In the above method (D), as the material for the spherical particles used, a material is preferable which enables part of each of the spherical particles to be ground and the planes to be formed in the step (D-iii). For that, if is preferable for the spherical particles to have a small Izod impact strength (ASTM D256). Also, for making the ground surfaces have the inclined planes, it is preferable for the spherical particles to have a large modulus in tension (ASTM D638). Stated specifically, as the spherical particles, it is preferable to use those having a modulus in tension of $20\times10^3$ kg/cm$^2$ or more and an Izod impact strength of 5 kg·cm/cm or less, in particular, a modulus in tension of $30\times10^3$ kg/cm$^2$ or more and an Izod impact strength of 2 kg·cm/cm or less. The material having such physical properties may include acrylic resins and styrene resins.

The acute internal angle made by the plane of each of the spherical particles standing exposed to the surface, and the plane i) that is orthogonal to a straight line passing through an axis of a section orthogonal to an axis of the roller for electrophotography and being directed toward the peripheral surface of the roller for electrophotography, and ii) that is tangential to the peripheral surface of the roller for electrophotography may also be controlled by selecting conditions for the grinding in the above step (D-iii).

Stated specifically, the angles of inclined planes can be changed as desired, by controlling, e.g., the rotational speed of a vulcanized rubber roller and that of the roller-shaped grinding wheel, i.e., grinding rate; the vulcanized rubber roller having a layer which contains the spherical particles and a vulcanized rubber as the resin binder and covers the peripheral surface of the roller-shaped conductive support.

For example, the grinding may preferably be carried out by means of a cylindrical grinder exclusively used for rubber rolls (trade name: LEO-600-F4L-BME, manufactured by Minakuchi Machinery Works Ltd.) and under working conditions as shown below. As the grinding wheel, it is preferable to use a hard grinding wheel material such as GC as a material for the grinding wheel and carry out the grinding with a coarse-grained grinding wheel having abrasive grains of #80 or less in grit. Also, as the hardness of the vulcanized rubber, it is preferable for the roller to be soft as long as the spherical particles do not come off the binder, and it is preferable to use a roller having a roller rubber microhardness of 75 or less. For the relative speed in the directions of rotation of the grinding wheel and work piece, it is preferable to be high, and is preferable for it to be set at 40 m/min or more. For the relative speed in the directions of approach of the grinding wheel and work piece, too, it is preferable to be high, and is preferable for it to be set at 10 m/min or more. After the distance in the directions of approach has become shortest and the roller has come to have the desired external diameter, it is preferable to immediately move the grinding wheel backward to shorten the time of contact between the roller and the grinding wheel.

Spherical particles of polyethylene resin or nylon resin which are known as particles used for the purpose of roughening the roller for electrophotography have an Izod impact strength of more than 5 kg·cm/cm, and are not cut at the time of grinding, where the inclined planes may be formed wish difficulty. Also, similarly in the case of spherical particles of urethane resin or rubber of various types, they have a modulus in tension of less than $20\times10^3$ kg/cm$^2$ and also an Izod impact strength of 5 kg·cm/cm or less, and hence the ground surfaces come horizontal and any inclined planes are not formed.

The modulus in tension and the Izod impact strength can not be measured on the sire of the spherical particles, and hence they may be measured on a test piece(s) made of the same material as the particles. The Izod impact, strength is measured according to ASTM D256, and the modulus in tension ASTM D638.

As the resin binder, it may preferably be a resin binder composed chiefly of NBR or epichlorohydrin rubber, having polarity (SP value) close to that of acrylic resin or styrene resin. Compared with a case in which a resin binder having a far polarity is used, the spherical particles may less come off the surface at the time of grinding.

Where the volume of elastic layer raw materials inclusive of the resin binder, the additives thereto and the spherical particles is assumed as 100%, the spherical particles may preferably be in a volume proportion of from 1% or more to 30% or less.

In regard to the grinding step, in the present invention, it is preferable to carry out the grinding at a strong shear force and in a short time as long as the desired surface roughness can be obtained. Doing it enables the spherical particles to avoid having horizontal ground surfaces.

—Conductive Support—

A material for the electrically conductive support may include, e.g., metals or alloys thereof, such as iron, copper, stainless steel, aluminum and nickel. The electrically conductive support may also be one coated with an adhesive for the purpose of bonding with the elastic layer, and such one may also be used. The adhesive may include those composed of a thermosetting resin or thermoplastic resin incorporated with a conducting agent. Usable are urethane resin type, acrylic resin type, polyester resin type, polyether resin type or epoxy resin type adhesives.

—Physical Properties of Roller for Electrophotography—

The electrical resistance and surface roughness of the roller for electrophotography according to the present invention may be, when it is used as a roller for contact charging, of any values as long as they are commonly required in the roller for contact charging. Stated specifically, they may be values as shown below.

It may have an electrical resistance of approximately from $1\times10^4\Omega$ to $1\times10^8\Omega$ in an environment of temperature 23° C. and relative humidity 50%. It may have, as its surface roughness, a surface ten-point average roughness Rzjis of from 2 μm or more to 30 μm or less and a surface hill-to-dale average distance Rm of from 15 μm or more to 150 μm or less. As the surface ten-point average roughness Rzjis and the surface hill-to-dale average distance Rm, values found by the measuring method chat accords with JIS B 0601-2001, standards of surface roughness may be employed. These may be measured by using a surface profile analyser SE-3400 (manufactured by Kosaka Laboratory Ltd.). Here, the Sm is a value found by measuring hill-to-dale distances at ten points in measurement length. The Rzjis and Sm are found by measuring the surface of the roller for electrophotography at 6 spots at random, and average values found may be employed.

—Electrophotographic Apparatus—

Figure 9:
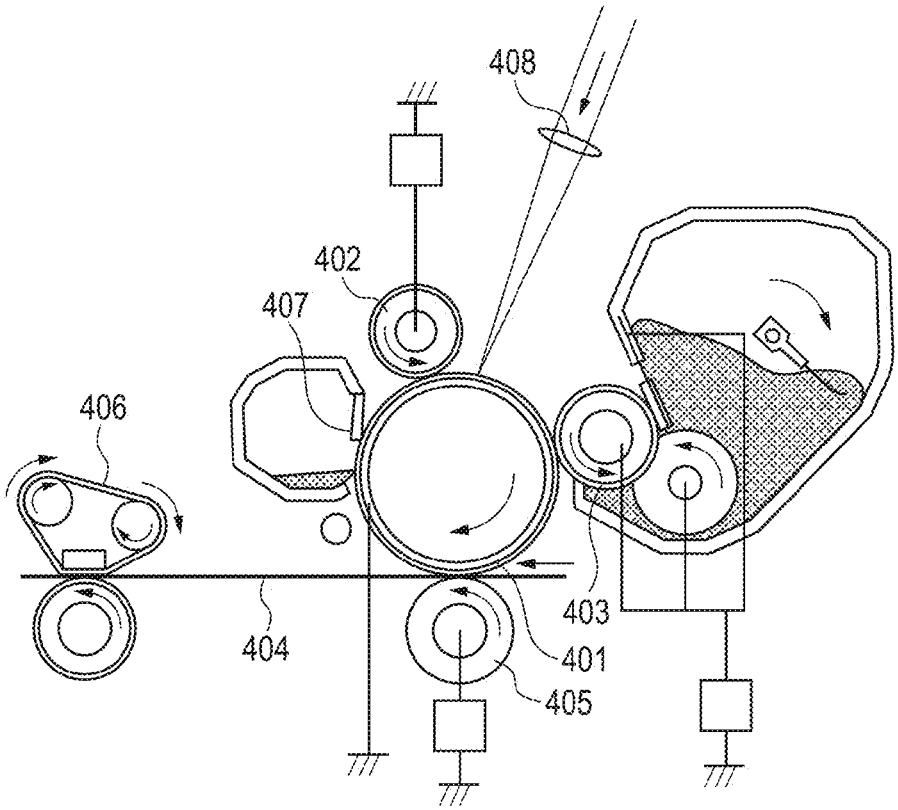
FIG. 9 shows an example of an electrophotographic apparatus.

FIG. 9 is a sectional view of an electrophotographic apparatus in which the roller for electrophotography according to the present invention is used as a charging roller. The electrophotographic apparatus has a photosensitive member 401, a charging roller 402 which charges this member electrostatically, an exposure unit (not shown) which emits therefrom light 408 for forming latent images, a developing assembly 403, a transfer assembly 405 which transfers toner images to a transfer material 404, a cleaning blade 407, a fixing assembly 406 and so forth.

The photosensitive member 401 is of a rotating drum type having a photosensitive layer on a conductive substrate. The photosensitive member 401 is rotatingly driven at a stated peripheral speed in the direction shown by an arrow.

The charging roller 402 is pressed against the photosensitive member 401 at a stated pressing force, and thereby provided in contact therewith. The charging roller 402 is follow-up rotated with the rotation of the photosensitive member, and a stated voltage is applied thereto from a charging power source 413 to charge the photosensitive member 401 electrostatically to a stated potential. As a latent image forming unit which forms latent images on the photosensitive member 401, an exposure unit such as a laser beam scanner is used, for example. The photosensitive member 401 thus charged uniformly is exposed to light in accordance with image information to form an electrostatic latent image thereon.

The developing assembly 403 has a contact type developing roller which is provided in contact with the photosensitive member 401. The electrostatic latent image is rendered visible and developed into a toner image by reverse development with a toner having electrostatically been processed to have the same polarity as charge polarity of the photosensitive member.

The transfer assembly 405 has a contact type transfer roller. The toner image is transferred from the photosensitive member 401 to a transfer material 404 such as plain paper. The cleaning blade 407 mechanically scrapes off and collects any transfer residual toner remaining on the photosensitive member 401. The fixing assembly 406 is constituted of a roll or the like to be kept heated, and fixes to the transfer material 404 the toner image having been transferred thereto.

Figure 10:
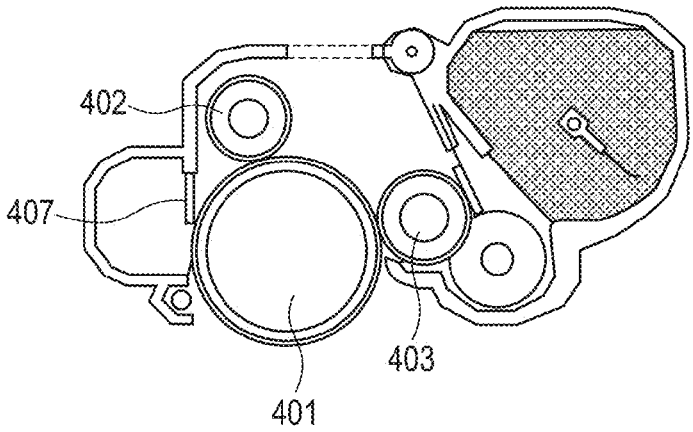
FIG. 10 shows an example of a process cartridge.

FIG. 10 is a sectional view of a process cartridge having a charging roller 402 according to the present invention, a photosensitive member 401, a developing assembly 403, a cleaning blade 407 and so forth which are integrally joined, and being so set up as to be detachably mountable to the main body of the electrophotographic apparatus.

The roller for electrophotography according to the present invention is suited as the charging roller used in contact charging of such electrophotographic apparatus and process cartridge as above.

EXAMPLES

Example 1

Preparation of Unvulcanized Rubber Composition 1 for Elastic Layer:

Materials shown below were mixed by means of a 6-liter pressure kneader (product name; TD6-15MDX; manufactured by Toshin Co., Ltd.) for 16 minutes in a packing of 70 vol. % and at a number of blade revolutions of 30 rpm to obtain an A-kneaded rubber composition.

TABLE 1

| | |
|---|---|
| NBR as resin binder (trade name: NIPOL DN225; available from Nippon Zeon Co., Ltd.) | 100 parts by mass |
| Zinc stearate as processing aid | 1 part by mass |
| Zinc oxide as vulcanization accelerator activator | 5 parts by mass |
| Calcium carbonate as filler | 30 parts by mass |
| Carbon black as conductive agent (trade name: TOKA BLACK #5500; available from Tokai Carbon Co., Ltd.) | 25 parts by mass |
| Acrylic resin particles as spherical particles (average particle diameter: 8 μm; trade name: TECHPOLYMER MBX-8; available from Sekisui Chemical Co., Ltd.) | 10 parts by mass |

Next, materials shown below were mixed by means of an open roll of 12 inches in roll diameter at a number of front-roll revolutions of 10 rpm and a number of back-roll revolutions of 8 rpm and at a roll gap of 2 mm, carrying out right and left 20 cuts in total. Thereafter, the roll gap was changed to 0.5 mm to carry out tailing 10 times to obtain an unvulcanized rubber composition 1 for elastic layer.

TABLE 2

| | |
|---|---|
| A-kneaded rubber composition obtained as above | 191 parts by mass |
| Sulfur as cross-linking agent | 1.2 parts by mass |
| Tetrabenzylthiuram disulfide as vulcanization accelerator (trade name: PERKACIT-TBzTD; available from Flexsys Co.) | 4.5 parts by mass |

Formation of Elastic Layer:

A columnar conductive mandrel (made of steel and plated with nickel on its surface) of 5 mm in diameter and 252 mm in length was coated with a conductive vulcanization adhesive (METALOC U-20, available from Toyokagaku Kenkyusho Co., Ltd.) over the column surface on its middle portion of 226 mm in axial direction, followed by drying at 80° C. for 30 minutes. In this Example, the columnar conductive mandrel coated with the conductive adhesive was used as an electrically conductive support. Next, the above unvulcanized rubber composition 1 was extruded together with the electrically conductive support while being shaped coaxially around the electrically conductive support and in the shape of a cylinder, by extrusion making use of a cross head, to produce an unvulcanized rubber roller of 7.8 mm in diameter which had the electrically conductive support and coated on the outer periphery thereof the unvulcanized rubber composition 1. As an extruders an extruder having a cylinder diameter of 45 mm (diam. 45) and an L/D of 20 was used, making temperature control to 90° C. for the head, 90° C. for a cylinder and 90° C. for a screw at the time of extrusion. The unvulcanized rubber roller thus shaped was cut at both end portions to make its elastic layer portion be 228 mm in width in its axial length. Thereafter, this was heated at 160° C. for 40 minutes by means of an electric furnace to obtain a vulcanized rubber layer.

The vulcanized rubber roller obtained was put to grinding on its surface by means of a plunge-cut grinder (trade name: "CNC Grinder Exclusively Used for Rubber Rolls, LEO-600-F4L-BME"; manufactured by Minakuchi Machinery Works Ltd.) to obtain a ground-finish rubber roller having an elastic layer, having a crown shape or 7.35 mm in end-portion diameter end 7.50 mm in middle-portion diameter. The grinding was carried out rising a grinding wheel (trade name: "Grinding Wheel GC-60-B-VRG-PM"; manufactured by Noritake Co., Limited) under conditions of a grinding wheel rotational speed of 2,800 rpm, a roller rotational speed of 333 rpm and a grinding rate of 30 mm/minute with respect to the diameter direction of the vulcanized rubber roller.

Electron Ray Treatment of Elastic Layer:

The ground-finish rubber roller was irradiated with electron rays on its surface to carry out cure treatment to obtain a roller 1 for electrophotography. In the irradiation with electron rays, an electron-ray irradiation equipment (manufactured by Iwasaki Electric Co., Ltd.) of 150 kV in maximum accelerating voltage and 40 mA in maximum electron current was used, and nitrogen gas purging was carried out at the time of the irradiation. Treatment conditions were accelerating voltage: 150 kV, electron current: 35 mA, treatment rate: 1 m/min, and oxygen concentration: 100 ppm.

The surface of the roller 1 for electrophotography was observed by a laser microscope VK8700 (manufactured by Keyence Co.) to find that spherical acrylic resin particles having inclined planes stood exposed to the surface. The acute internal angle the plane tangential to the peripheral surface of the roller 1 for electrophotography and the planes of the spherical particles having inclined planes form was 10°. Also, as to the coefficient of static friction, the coefficient of dynamic friction and the ten-point average roughness Rzjis which were measured by the method described previously, the coefficient of static friction was 0.67, the coefficient of dynamic friction was 0.34 and the Rzjis was 6.8 μm.

—Evaluation 1—

Evaluation on Image Non-Uniformity Due to Slippage at the Initial Stage of Rotation:

Using the roller 1 for electrophotography, image evaluation was made in the following way.

First, as an electrophotographic apparatus used in the evaluation, an electrophotographic apparatus (trade name: LBP7200C; manufactured by CANON INC.) was used which was so converted for high-speed as to have a recording medium feeding speed of 200 mm/sec. Also, bearings of a charging roller of a black process cartridge for the electrophotographic apparatus were so converted that a charging roller having a smaller diameter than the regular charging roller was holdable therewith. Then, the roller 1 for electrophotography was set as a charging roller in the process cartridge thus converted. This process cartridge was mounted to the electrophotographic apparatus.

As described above, about the electrophotographic apparatus used for the evaluation, its recording medium feeding speed was made higher than usual and also the charging roller was made smaller in diameter. This provided conditions more tending to cause image non-uniformity due to roller slippage.

As images for evaluation, halftone images (medium-density images where horizontal lines of one dot in width and two dots in space were drawn in the direction perpendicular to the rotational direction of the photosensitive member) were reproduced. About such halftone images, two types of images, actual-service images having been image-processed by dithering with a laser exposure pattern and study-purpose images having not been image-processed so as to make any image non-uniformity due to the charging roller more easily recognizable were reproduced to make evaluation according to the following criteria.

A: in the halftone images having not been image-processed, any horizontal band-like image non-uniformity is not observed.

B: In the halftone images having not been image-processed, the horizontal band-like image non-uniformity is slightly observed, but, in the halftone images having been image-processed in the cycle of the charging roller in its peripheral length, any horizontal band-like image non-uniformity is not observed in the cycle of the charging roller in its peripheral length.

C: In the halftone images having not been image-processed, the horizontal band-like image non-uniformity is observed in the cycle of the charging roller in its peripheral length, but, in the halftone images having been image-processed, any horizontal band-like image non-uniformity is not observed in the cycle of the charging roller in its peripheral length.

D: In the halftone images having been image-processed, the horizontal band-like image non-uniformity is observed in the cycle of the charging roller in its peripheral length.

In this evaluation, the horizontal band-like image non-uniformity in the cycle of the charging roller in its peripheral length is known to occur at the position of contact between the charging roller and the photosensitive member before their drive. As the result, the roller 1 for electrophotography was evaluated as "A" on the image non-uniformity due to roller slippage at the initial stage of rotation.

—Evaluation 2—

Evaluation on Image Non-Uniformity Due to Sticking of Contaminants:

Using the roller 1 for electrophotography, image evaluation was made in the following way. In this evaluation, the same electrophotographic apparatus as that used in Evaluation 1 was used.

Running conditions under which contaminants were made to stick to the charging roller were so set that the electrophotographic apparatus was stopped upon reproduction of images on one sheet and the operation to form images are again started after 10 seconds, and this drive was repeated to form electrophotographic images on 15,000 sheets. Images reproduced were images printed on A4-size sheets each at random in 1 area percent (%) of their image-forming areas.

After such a running test, as images for evaluation, the two types of images, the halftone images having been image-processed and the halftone images having not been image-processed were reproduced to make evaluation according to the following criteria.

A: In the halftone images having not been image-processed, any vertical line-like image non-uniformity is not observed.

B: In the halftone images having not been image-processed, the vertical line-like image non-uniformity is slightly observed, but, in the halftone images having been image-processed any vertical line-like image non-uniformity is not observed.

C: In the halftone images having not been image-processed, the vertical line-like image non-uniformity is observed, but, in the halftone images having been image-processed, any vertical line-like image non-uniformity is not observed.

D: In the halftone images having been image-processed, the vertical line-like image non-uniformity is observed.

In this evaluation, the vertical line-like image non-uniformity is known to correspond to the non-uniformity in sticking of the contaminants to the surface of the charging roller. As the result, the roller 1 for electrophotography was evaluated as "A" on the image non-uniformity due to sticking of contaminants.

Examples 2 to 8

Rollers for electrophotography of Examples 2 to 8 were produced in the same way as Example 1 except that, in place of the spherical particles in Example 1, the type of particles, their average particle diameters and the parts by mass for their addition were changed as shown in Table 7. These were evaluated in the same way. Where the type of particles and the average particle diameter were changed, the following spherical particles were used.

TABLE 3

| | |
|---|---|
| Acrylic resin particles | Average particle diameter: 5 μm; trade name: TECHPOLYMER MBX-5; available from Sekisui Chemical Co., Ltd. |
| Acrylic resin particles | Average particle diameter: 12 μm; trade name: TECHPOLYMER MBX-12; available from Sekisui Chemical Co., Ltd. |
| Acrylic resin particles | Average particle diameter: 20 μm; trade name: TECHPOLYMER MBX-20; available from Sekisui Chemical Co., Ltd. |
| Styrene resin particles | Average particle diameter; 8 μm; trade name: TECHPOLYMER SBX-8; available from Sekisui Chemical Co., Ltd. |

Example 9

A charging roller of Example 9 was produced in the same way as Example 1 except that, in place of the electron ray treatment in Example 1, ultraviolet ray treatment was carried out. This was evaluated in the same way. In the irradiation with ultraviolet rays, a low-pressure mercury lamp (trade name: GLQ500US/11; manufactured by Harison Toshiba Lighting Corporation) was used, and the surface was uniformly irradiated while the charging roller was rotated. The amount of light of ultraviolet rays was so set as to be 8,000 mJ/cm$^2$ as sensitivity in a 254 nm sensor.

Example 10

A roller for electrophotography according to Example 10 was produced in the same way as Example 1 except that the unvulcanized rubber composition 1 was changed to the following unvulcanized rubber composition 2. This was evaluated in the same way.

Preparation of Unvulcanized Rubber Composition 2 for Elastic Layer:

Materials shown below were mixed by means of a 6-liter pressure kneader (product name: TD6-15MDX; manufactured by Toshin Co., Ltd.) for 16 minutes in a packing of 70 vol. % and at a number of blade revolutions of 30 rpm to obtain an A-kneaded rubber composition.

TABLE 4

| | |
|---|---|
| Epichlorohydrin rubber as resin binder (trade name: EPICHLOMER CG102, available from Daiso Co., Ltd.) | 100 parts by mass |
| Zinc stearate as processing aid | 1 part by mass |
| Zinc oxide as vulcanization accelerator activator | 5 parts by mass |
| Calcium carbonate as filler | 40 parts by mass |
| Adipic acid ether ester as plasticizer (trade name: ADEKACIZER RS-107; available from ADEKA Corporation) | 10 parts by mass |
| 2-Mercaptobenzimidazole (MB) as age resistor | 1 part by mass |
| Quaternary ammonium salt as ion conduction agent | 2 parts by mass |
| Acrylic resin particles as spherical particles (average particle diameter: 8 μm; trade name: TECHPOLYMER MBX-8; available from Sekisui Chemical Co., Ltd.) | 10 parts by mass |

Next, materials shown below were mixed by means of an open roll of 12 inches in roll diameter at a number of front-roll revolutions of 8 rpm and a number of back-roll revolutions of 10 rpm and at a roll gap of 2 mm, carrying out right and left 20 cuts in total. Thereafter, the roll gap was changed to 0.5 mm to carry out tailing 10 times to obtain an unvulcanized rubber composition 2 for elastic layer.

TABLE 5

| | |
|---|---|
| A-kneaded rubber composition obtained as above | 169 parts by mass |
| Sulfur as cross-linking agent | 1.2 parts by mass |
| Tetrabenzylthiuram disulfide as vulcanization accelerator (trade name: PERKACIT-TBzTD; available from Flexsys Co.) | 4.5 parts by mass |

Example 11

Preparation of Unvulcanized Rubber Composition 3 for Elastic Layer:

An unvulcanized rubber composition 3 was prepared in the same way as the preparation of the unvulcanized rubber composition 1 except that, in preparing the unvulcanized rubber composition 1, the spherical particles were not added.

Formation of Elastic Layer:

An unvulcanized rubber roller of 7.8 mm in diameter which had an electrically conductive support and coated on the outer periphery thereof the unvulcanized rubber composition 3 was produced in the same way as Example 1.

Hemispherical-shaped spherical particles which were composed of acrylic resin and 8 μm in average particle diameter were all over laid on a sheet made of polytetrafluoroethylene (PTFE), and then the unvulcanized rubber roller was rolled down it, whereby the hemispherical-shaped spherical particles were transferred to the surface of the unvulcanized rubber roller from the sheet made of PTFE.

As conditions under which the hemispherical-shaped spherical particles were all over laid on the sheet made of PTFE, the particles were laid in such ways that the planes of hemispheres faced toward the sheet made of PTFE and that the hemispherical-shaped spherical particles laid thereon were in an area percentage of 10% when the sheet made of PTFE was viewed from the upside. The unvulcanized rubber roller was rolled down the sheet made of PTFE, at a rate of 100 mm/second under application of a load of 500 g on both ends of the roller.

The unvulcanized rubber roller to the surface of which the hemispherical-shaped spherical particles were thus made to adhere was cut at its both end portions to make the elastic layer portion have a width of 228 mm in its axial direction, and thereafter put to heat treatment in an electric oven at 160° C. for 40 minutes to obtain a vulcanized rubber roller.

Electron Ray Treatment of Elastic Layer:

This vulcanized rubber roller was subjected to electron ray treatment on its surface in the same way as Example 1 to obtain a charging roller of Example 11. About this charging roller of Example 10, evaluation was made in the same way as Example 1.

Comparative Examples 1 and 2

Charging rollers of Comparative Examples 1 and 2 were produced in the same way as Examples 1 and 8, respectively, except that the spherical particles in Examples 1 and 8 were not added. These were evaluated in the same way.

Comparative Examples 3 to 5

Charging rollers of Comparative Examples 3 to 5 were produced in the same way as Example 1 except that, in place of the spherical particles in Example 1, the type of particles, their average particle diameters and the parts by mass for their addition were changed as shown in Table 6 below. These were evaluated in the same way. As the spherical particles, the following particles were used.

TABLE 6

| | |
|---|---|
| Silica particles | Average particle diameter: 8 μm; trade name: HS-205; available from Nippon Steel & Sumikin Materials Co., Ltd., Micron Co. |
| Silicone resin particles | Average particle diameter: 8 μm; trade name: TORAYFIL R R-902A; available from Dow Corning Toray Silicone Co., Ltd. |
| Urethane resin particles | Average particle diameter: 10 μm; trade name:; ART PEARL C600 Transparent; available from Negami Chemical Industrial Co,. Ltd. |

TABLE 7

| | Particles | | | | |
|---|---|---|---|---|---|
| | Type | Particle diam. (μm) | Amount (parts) | Resin binder | Surface treatment |
| Example: | | | | | |
| 1 | Acrylic | 8 | 10 | NBR | Electron rays |
| 2 | Acrylic | 4 | 10 | NBR | Electron rays |
| 3 | Acrylic | 12 | 10 | NBR | Electron rays |
| 4 | Acrylic | 20 | 10 | NBR | Electron rays |
| 5 | Acrylic | 8 | 5 | NBR | Electron rays |
| 6 | Acrylic | 8 | 20 | NBR | Electron rays |
| 7 | Acrylic | 4 | 20 | NBR | Electron rays |
| 8 | Acrylic | 8 | 10 | NBR | Electron rays |
| 9 | Acrylic | 8 | 10 | NBR | UV rays |
| 10 | Acrylic | 8 | 10 | ECO | Electron rays |
| 11 | Acrylic | 8 | — | NBR | Electron rays |
| Comparative Example: | | | | | |
| 1 | | No particles | | NBR | Electron rays |
| 2 | | No particles | | NBR | UV rays |
| 3 | Silica | 8 | 10 | NBR | Electron rays |
| 4 | Silicone | 8 | 10 | NBR | Electron rays |
| 5 | Urethane | 10 | 10 | NBR | Electron rays |

TABLE 8

| | Particle shape | Particle plane internal angle (°) | Rzjis (μm) | Coefficients of friction | | Horizontal band-like image non-uniformity due to slippage | Vertical line-like image non-uniformity due to contaminants |
|---|---|---|---|---|---|---|---|
| | | | | Static friction | Dynamic friction | | |
| Example: | | | | | | | |
| 1 | Inclined plane | 10 | 6.8 | 0.67 | 0.31 | A | A |
| 2 | Inclined plane | 6 | 6.1 | 0.64 | 0.37 | B | C |
| 3 | Inclined plane | 13 | 7.5 | 0.52 | 0.32 | C | B |
| 4 | Inclined plane | 17 | 9.4 | 0.50 | 0.28 | C | A |
| 5 | Inclined plane | 10 | 5.9 | 0.66 | 0.39 | B | C |
| 6 | Inclined plane | 9 | 7.2 | 0.60 | 0.25 | C | A |
| 7 | Inclined plane | 5 | 6.3 | 0.52 | 0.37 | C | C |
| 8 | Inclined plane | 7 | 6.5 | 0.64 | 0.32 | B | B |
| 9 | Inclined plane | 8 | 6.3 | 0.51 | 0.23 | C | A |
| 10 | Inclined plane | 9 | 7.8 | 0.70 | 0.40 | A | C |
| 11 | Inclined plane | 28 | 5.8 | 0.50 | 0.32 | C | B |
| Comparative Example: | | | | | | | |
| 1 | — | — | 5.4 | 0.69 | 0.60 | A | D |
| 2 | — | — | 5.4 | 0.40 | 0.35 | D | C |
| 3 | Sphere | — | 14.7 | 0.32 | 0.27 | D | A |
| 4 | Come off | — | 6.5 | 0.63 | 0.59 | B | D |
| 5 | Horizontal plane | 0 | 4.8 | 0.67 | 0.64 | A | D |

From comparison between Examples and Comparative Examples as shown in Table 8, it is seen that, in the charging roller to the surface of which the particles having inclined planes stand exposed, the image non-uniformity due to slippage and that due to contaminants have been remedied. It is further seen that, the higher the coefficient of static friction is, the higher the effect of remedying the image non-uniformity due to slippage is, and that, the lower the coefficient of dynamic friction is, the higher the effect of remedying the image non-uniformity due to contaminants is.

In Comparative Example 1, a high coefficient of dynamic friction resulted because the elastic layer did not contain any spherical particles, and the vertical line-like image non-uniformity due to contaminants was evaluated as "D". In Comparative Example 2, the ultraviolet ray treatment was carried out, which lowered the coefficients of friction compared with the electron ray treatment in Comparative Example 1, and the horizontal band-like image non-uniformity due to slippage was so much because of a low coefficient of static friction as to be evaluated as "D". In Comparative Example 3, the silica spherical particles standing exposed to the surface kept the shape of particles as they were, and hence the horizontal band-like image non-uniformity due to slippage was so much because of a low coefficient of static friction as to be evaluated as "D".

In Comparative Example 4, the spherical particles of silicone resin came off at the time of grinding, so that the roller surface had hollows made by the silicone resin spherical particles having come off, and hence a high coefficient of dynamic friction resulted like the case in which the elastic layer did not contain any spherical particles, thus the vertical line-like image non-uniformity due to contaminants was evaluated as "D". In Comparative Example 4, the ground surfaces of the spherical particles of urethane resin stood horizontal to the plane tangential to the peripheral surface of the charging roller, and hence a high coefficient of dynamic friction resulted, thus the vertical line-like image non-uniformity due to contaminants was evaluated as "D". In Comparative Example 5, the ground surfaces of the spherical particles of acrylic resin stood horizontal to the imaginary plane tangential to the peripheral surface of the charging roller, and hence a high coefficient of dynamic friction resulted, thus the vertical line-like image non-uniformity due to contaminants was evaluated as "D".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures end functions.

This application claims the benefit of Japanese Patent Application No. 2012-008344, filed Jan. 18, 2012, which is hereby incorporated by reference herein in its entirety.

What is claimed is:

1. A roller for electrophotography, comprising an electrically conductive support and an elastic layer as a surface layer, wherein the elastic layer holds spherical particles each having a plane on their peripheral surfaces, in such a way that part or the whole of the plane comes exposed to the surface of the elastic layer, and wherein the plane of each of the spherical particles standing exposed to the surface of the elastic layer, and a plane that is orthogonal to a straight line passing through an axis center in a section orthogonal to an axis of the roller for electrophotography and being directed toward the peripheral surface or the roller for electrophotography, and that is tangential to the peripheral surface of the roller for electrophotography, make an acute internal angle.

2. The roller for electrophotography according to claim 1, wherein the acute internal angle is from 4 degrees to 30 degrees, the acute internal angle being made by the plane of each of the spherical particles standing exposed to the surface of the elastic layer, and a plane:

that is orthogonal to a straight line passing through an axis of a section orthogonal to an axis of the roller for electrophotography and being directed toward the peripheral surface of the roller for electrophotography, and that is tangential to the peripheral surface of the roller for electrophotography.

3. The roller for electrophotography according to claim 2, wherein:

the acute internal angle is from 5 degrees to 20 degrees, the acute internal angle being made by the plane of each of the spherical particles standing exposed to the surface of the elastic layer, and a plane:

that is orthogonal to a straight line passing through an axis of a section orthogonal to an axis of the roller for electrophotography and being directed toward the peripheral surface of the roller for electrophotography, and that is tangential to the peripheral surface of the roller for electrophotography.

4. The roller for electrophotography according to claim 1, wherein:

the spherical particles have a volume average particle diameter of from 3 μm to 50 μm.

5. The roller for electrophotography according to claim 1, wherein the elastic layer comprises a resin binder.

6. The roller for electrophotography according to claim 5, wherein the resin binder comprises an acrylonitrile-butadiene copolymer or an epichlorohydrin rubber.

7. The roller for electrophotography according to claim 1, wherein the spherical particles comprise an acrylic resin or a styrene resin.

8. The roller for electrophotography according to claim 1, wherein the roller for electrophotography is a charging roller.

9. A process for producing the roller for electrophotography according to claim 1, the process comprising the steps of:

forming on an electrically conductive support an elastic layer containing a resin binder in which spherical particles have been dispersed; and thereafter grinding the surface of the elastic layer to make part of each of the spherical particles exposed to the surface and at the same time form a plane on each peripheral surface of the spherical particles.

10. The process according to claim 9, wherein the resin binder comprises an acrylonitrile-butadione copolymer or an epichlorohydrin rubber and the spherical particles comprise an acrylic resin or a styrene resin.

11. An electrophotographic apparatus comprising a charging roller and a rotating drum-type photosensitive member disposed in contact with the charging roller;

the charging roller being the roller for electrophotography according to claim 1.

12. A process cartridge comprising a charging roller and a rotating drum-type photosensitive member disposed in contact with the charging roller, and being so constituted as to be detachable mountable to the main body of an electrophotographic apparatus;

the charging roller being the roller for electrophotography according to claim 1.

13. A roller for electrophotography, comprising an electrically conductive support and an elastic layer as a surface layer, wherein the elastic layer contains a resin binder and spherical particles for roughening the surface of the roller for electrophotography, and the spherical particles each have a plane on their peripheral surfaces, and part or the whole of the plane of each of the spherical particles stands exposed to the surface of the surface layer in such a way as to be directed toward the outside of the elastic layer.

14. The roller for electrophotography according to claim 13, wherein the roller for electrophotography is a charging roller.

* * * * *